United States Patent [19]

Swisher

[11] 3,965,992

[45] June 29, 1976

[54] INTERNALLY SILENCED IMPACT DRIVEN TOOLS AND IMPACTING MEANS THEREFOR

[76] Inventor: James A. Swisher, 123 Silver Hill Road, Easton, Conn. 06612

[22] Filed: Mar. 6, 1975

[21] Appl. No.: 556,186

[52] U.S. Cl. ..... 173/127; 92/260; 173/DIG. 2; 181/36 A

[51] Int. Cl.[2] ..... B25D 9/00

[58] Field of Search ..... 181/33 A, 33 B, 36 A; 173/127, 139, DIG. 2, 162, 131; 175/135, 56, 320; 92/255, 260

[56] References Cited

UNITED STATES PATENTS

| | | | |
|---|---|---|---|
| 1,167,975 | 1/1916 | Burlingham | 173/127 |
| 2,604,914 | 7/1952 | Kahlen | 149/29 B |
| 2,737,216 | 3/1956 | Kenerson | 149/29 B |
| 3,605,832 | 9/1971 | Stephens | 145/29 B X |
| 3,662,855 | 5/1972 | Adams et al. | 173/139 X |
| 3,861,494 | 1/1975 | Grego | 181/33 A |

FOREIGN PATENTS OR APPLICATIONS

| | | | |
|---|---|---|---|
| 1,095,235 | 5/1959 | France | 92/260 |
| 515,807 | 12/1939 | United Kingdom | 173/DIG. 2 |

*Primary Examiner*—Ernest R. Purser
*Assistant Examiner*—Richard E. Favreau
*Attorney, Agent, or Firm*—Wooster, Davis & Cifelli

[57] ABSTRACT

Impact driven tools of the type generally comprising a bitter end bounded by a collar and a shank and a tip are provided with internal silencing means comprising an opening in the bitter end, said opening filled with a sound attenuating material, which is preferably steel shot loosely packed in the opening and retained therein by a force fit plug secured by a weld. The opening is preferably axial and extends through the bitter end to or below the collar. In large diameter impact driven tools multiple openings are provided parallel to the axis and terminating at staggered points. Each such hole is filled with a sound attenuating material, such as steel shot. The rams of impacting apparatus, or air hammers, are also provided with internal silencing means comprising at least one opening, each such opening being filled with sound attenuating material, which is preferably steel shot loosely packed and retained by a force fit plug secured by a weld.

16 Claims, 7 Drawing Figures

Fig. 2.
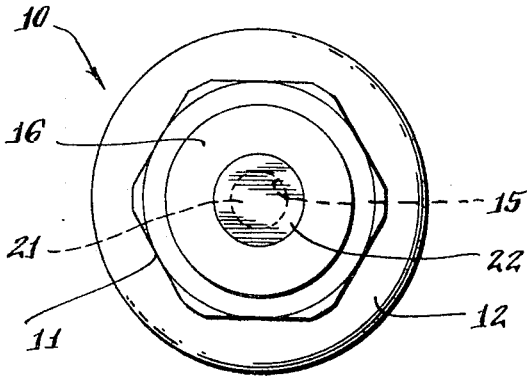
Fig. 3.
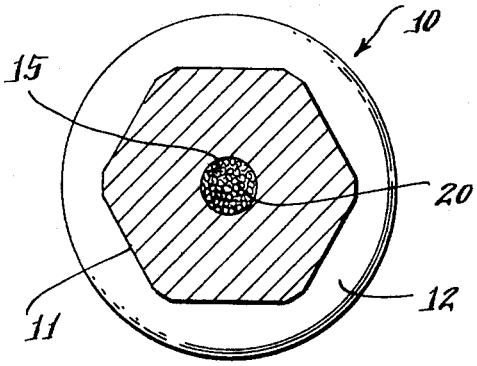
Fig. 6.
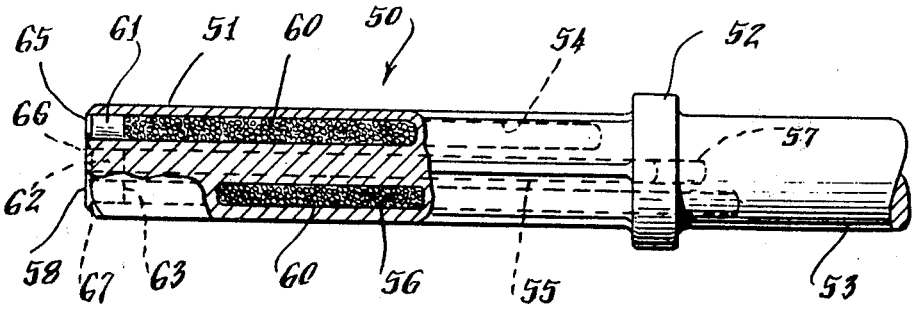
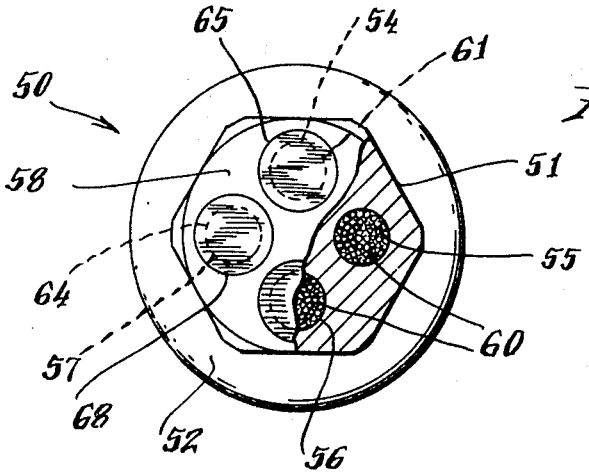
Fig. 7.

INTERNALLY SILENCED IMPACT DRIVEN TOOLS AND IMPACTING MEANS THEREFOR

BACKGROUND OF THE INVENTION

This invention relates to silenced impact driven tools and to silenced impacting apparatus associated therewith, and particularly to internal silencing means wholly contained within the impact driven tools and impacting apparatus therefor.

Impact driven tools generally comprise a bitter end and collar adapted to be received within an impacting apparatus, and a shank extending from the collar to a tip. The tip may be sharpened to provide the working surface of the tool, or may be adapted to receive a replaceable sharpened tip providing the working surface of the tool as disclosed in my U.S. Pat. No. 3,655,244. The impacting apparatus, commonly known as an air hammer or pneumatic drill, in which the impact driven tools are used, generally comprises means for holding the bitter end and collar of the tool, and hammer means pneumatically driven to strike the bitter end of the tool. The combination of an impacting apparatus and impact driven tool is a common sight around construction jobs and is used to break pavement, concrete, and the like.

The impacting apparatus and impact driven tools are extremely noisy in operation, and constitute a disturbance, annoyance and nuisance. The problem is sufficiently acute that the noise levels produced by these tools are now being regulated by law to not exceed certain limits as expressed in decibels. However, the manufacturers of impact driven tools and impacting apparatus are experiencing a great deal of difficulty in meeting the noise level standards.

When an impact driven tool is struck by the hammer of an impacting apparatus, two types of sound producing motions are created within the impact driven tool. First, a lateral mode of vibration is created, and the lateral mode consists generally of motion with respect to the axis of the tool. My U.S. Pat. No. 3,848,931 deals effectively with the lateral mode of sound producing motion.

The second type of motion is in the longitudinal or axial mode, i.e., along and parallel to the axis of the impact driven tool. This type of sound producing motion is also created in the hammer of the impacting apparatus used to strike the tool.

SUMMARY OF THE INVENTION

Silencing of impact driven tools and the hammers of impacting apparatus therefor is accomplished according to the invention herewith by forming at least one opening parallel to or on the axis of such impact driven tools or hammers, and filling the opening with a sound vibration attenuating material, preferably steel shot. The opening is sealed to encapsulate the sound vibration attenuating material therein. The openings do not affect materially the strength of the impact driven tools or hammers of pneumatically driven impacting apparatus for use therewith, particularly in the preferred embodiments of the impact driven tools wherein the longitudinal opening extends through the bitter end of the tool to or below the collar.

The internally silenced impact driven tool achieves reduced noise levels in operation compared to conventional impact driven tools similar in size and shape and noise level reductions on the order of 1 ½ to 3 ½ decibels have been achieved in comparison testing. The reductions in noise level are greater when both the impact driven tool and the hammer of the impacting apparatus are both provided with internal silencers according to the invention. The internally silenced impact driven tools are easily manufactured from existing impact driven tools, and are readily received and used with prior art pneumatic impacting apparatus. Similarly, hammers for impacting apparatus can be modified to the internally silenced structure according to the invention herein and as modified can still be used with the remaining portions of the existing impacting apparatus. Thus, the invention can be put into practice with minimal disruption.

OBJECTS OF THE INVENTION

Accordingly, it is a principal object of the invention to provide for reduced noise levels in the operation of impact driven tools.

It is another object of the invention to provide impact driven tools including internal silencing means for achieving noise reduction during operation thereof.

It is an additional object of the invention to provide impacting apparatus for achieving noise reduction in use with impact driven tools.

It is a further object of the invention to provide impact driven tools and hammers of impacting apparatus for use therewith which are compatible with existing impacting apparatus but are more quiet in operation.

It is yet another object of the invention to provide such impact driven tools and impacting apparatus which are durable.

It is a still further object of the invention to provide internally silenced impact driven tools which can be resharpened without adversely affecting the internal silencing means.

Other and more specific objects of the invention will in part be obvious and will in part appear from a perusal of the following description of the preferred embodiments and the claims, taken together with the drawings.

DRAWINGS

FIG. 2 is an end elevation view of the impact driven tool of FIG. 1;

FIG. 3 is a sectional view of the impact driven tool of FIG. 1 taken along the lines 3—3 of FIG. 1;

FIG. 6 is a side elevation view, partially in section and partially cutaway, of another impact driven tool according to the invention herein; and FIG. 7 is an end view, partially in section, of the impact driven tool of FIG. 6.

The same reference numbers refer to the same elements throughout the various Figures.

DESCRIPTION OF THE PREFERRED EMBODIMENTS

Figure 1:
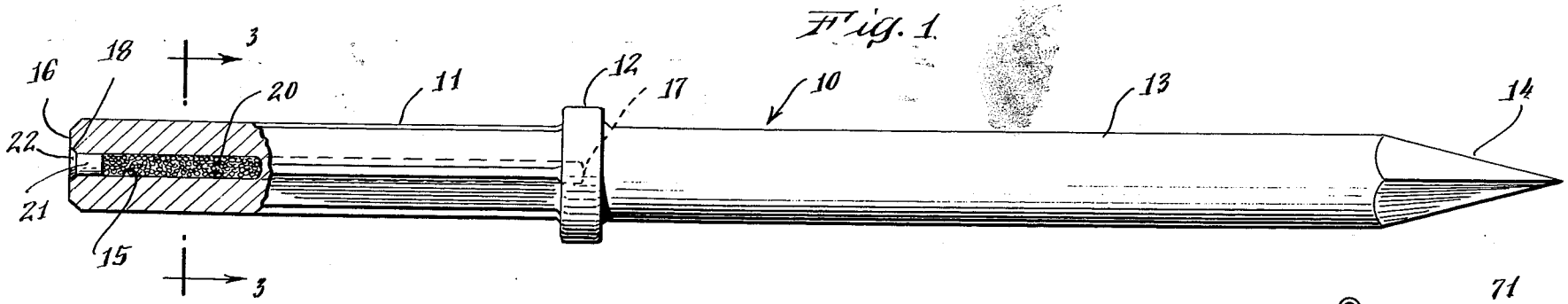
FIG. 1 is a side elevation view, partially in section, of an impact driven tool according to the invention herein.

Referring now to FIG. 1, there is shown an impact driven tool 10 according to the invention herein. The impact driven tool 10, generally comprises a hexagonal bitter end 11, bounded by a collar 12, and a shank 13 provided at its lower end with a sharpened tip 14. An opening 15 extends through the bitter end 11 of the impact driven tool 10 from the impact surface 16 to the collar 12 thereof. The opening 15 is preferably disposed along the axis of the impact driven tool, as is shown in FIGS. 1 – 3. The lower end of opening 15, indicated at 7, is preferably rounded to reduce the possibility of fatigue cracks developing between the opening 15 and the outer surface of the impact driven tool 10. Also, the lower end 17 of opening 15 is surrounded by the collar 12, and the collar provides a strong portion of the impact driven tool at which to terminate the opening 15. The upper portion of opening 15 adjacent to the impact surface 16 is countersunk, as indicated at 18.

The bitter end 11 of the impact driven tool 10 is approximately 6 ¼ inches in length and the collar 12 is approximately ½ inch in length. The diameter of the bitter end 11 is approximately 1 ¼ inches. The opening 15 is accordingly approximately 6 ½ inches in depth from the impact surface 16, and is preferably in the range of ¼ to ⅜ inch in diameter. A greater diameter of the opening may result in an impact driven tool insufficiently strong to perform the work generally required of such tools, and an opening of lesser diameter would be insufficient to achieve the noise reduction which is an object of the invention herein. It will be appreciated that the foregoing dimensions are given by way of example only, and that different sizes of impact driven tools would be provided with an appropriately sized opening.

The opening 15 is filled with sound attenuating material, which is preferably heat treated round steel shot 20 having a diameter on the order of 0.030 inch. Such shot is also known as "peening shot." The 0.030 inch peening shot is considered to be marginally superior as a sound attenuating material to larger shot, such as a shot having a diameter of approximately 0.055 inch. However, larger shot also works well as a sound attenuating material, particularly in openings of larger diameter in larger impact driven tools. Lead shot was also tried, but the lead shot flatened and congealed after short periods of use, at which time the silencing benefits were lost. Both lead and rubber sound attenuating material are also not believed to be practical for use in filling opening 15 in the impact driven tool 10 because impact driven tools of this type are heated to relatively high temperatures for resharpening, the temperatures being sufficiently high to melt lead and destroy most rubber compounds. The shot 20 is loosely packed in the opening 15 and fills the opening 15 except for approximately ¾ inch thereof adjacent to the impact surface 16. A cylindrical steel plug 21 having an axial dimension of approximately ⅜ to ½ inch is force-fit into the opening 15 and retains the shot 20 therein. The plug 21 is positioned sufficiently far into the opening 15 that the countersunk portion 18 of the opening is exposed. The plug 21 is secured in the opening 15 by welding, and in particular, the weld 22 fills the countersunk portion 18 of the opening 15 and the weld 22 is ground smooth with the impact surface 16.

When used in combination with a conventional air hammer the impact driven tool 10 described above achieves reductions on the order of 1 ½ to 3 ½ decibels in noise level during operation as compared to conventional impact driven tools while attaining comparable performance.

Figure 5:
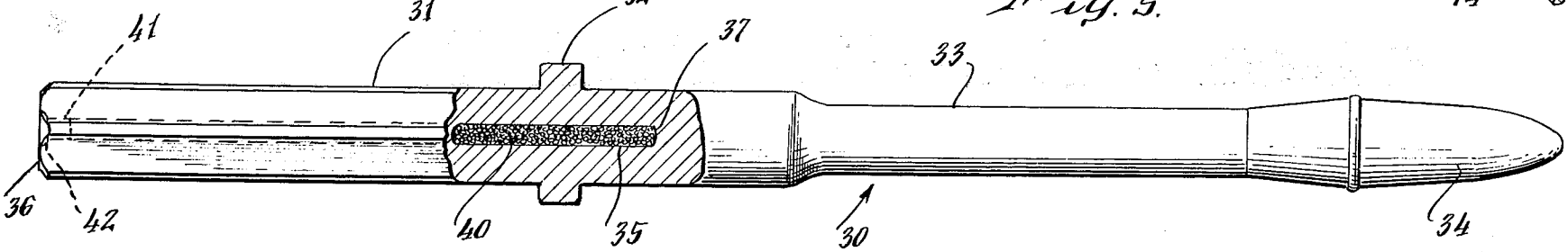
FIG. 5 is a side elevation view, partially in section, of another impact driven tool according to the invention herein.

Referring now to FIG. 5, there is illustrated an impact driven tool 30 comprising a second embodiment of the invention herein. The impact driven tool 30 generally comprises a bitter end 31 bounded by an annular collar 32 and a stepped shank 33 terminating in a rounded end 34 which is adapted to receive a replaceable tip (not shown) having a sharpened working surface. The stepped shank 33 increases the performance of the tool and also contributes to quiet operation.

The impact driven tool 30 is provided with an axial opening 35 extending from the tool's impact surface 36 to a rounded end indicated at 37 in the shank 33 below the collar 32. The dimensions of the bitter end 31 and collar 32 of the impact driven tool 30 are similar to the dimensions of the corresponding parts of the impact driven tool 10, and the overall length of opening 35 is approximately 7 ½ inches.

The opening 35 is filled with a sound attenuating material, preferably loosely packed peening shot 40, and the opening 35 is sealed with a force-fit plug 41 secured by a weld 42.

The impact driven tool 30 was tested and found to be quieter than a similar impact driven tool without the opening 35 and sound attenuating shot 40 therein. The impact driven tool 30 was durable despite the opening 35 extending into the shank 33 below the collar 32. However, impact driven tools were made and tested with an axial opening in the bitter end terminating above the collar, and such impact driven tools suffered early failures by breakage, although they did achieve reductions in the noise level during operation. Such impact driven tools, therefore, would be useful in situations where less strength is required.

It was noted that as the length of the opening in the bitter end of impact driven tools similar to those described above was varied, the reduction in the noise level during operation also varied, depending, however, on the surface on which the impact driven tool was doing work, e.g. black top, concrete, and granite, and also depending upon the frequency range in which the noise level was being measured. For instance, an impact driven tool with an opening of depth 6 inches might produce less 1000 c.p.s. noise on a concrete surface than an impact driven tool having an opening of depth 7 ½ inches, but the reverse might occur when the impact driven tools are run on granite. Similarly, different noise levels were produced at different frequency ranges, and the impact driven tool with an opening of depth 6 inches might be more quiet than the impact driven tool with an opening of depth 7 ½ inches at some frequency but not at others. However, all of the impact driven tools have an opening and sound attenuating material therein achieved reductions in noise level during operation when compared to conventional prior art impact driven tools.

Referring now to FIGS. 6 and 7, there is shown an impact driven tool 50 according to the invention herein. Impact driven tool 50 generally comprises a bitter end 51 bounded by a collar 52, a shank 53 (partially shown), and a tip (not shown). The impact driven tool 50 is similar to the impact driven tool 10 described above except for size, the diameter of the bitter end 51 of the impact driven tool 50 being on the order of approximately 4 inches.

The impact driven tool 50 is provided with four openings 54 – 57 extending inwardly from its impact surface 58 and parallel to its longitudinal axis. The openings 54 – 57 are of different depths, and accordingly, terminate at staggered points within the impact driven tool 50. For example, opening 54 terminates above the collar 52, opening 55 terminates at the collar 52, and openings 56 and 57 terminate below the collar 52. Each of the openings 54 – 57 are filled with loosely packed steel shot 60 as a sound attenuating material, and the openings 54 – 57 are closed respectively by plugs 61 – 64 and welds 65 – 68, similar to the manner described above with respect to impact driven tool 10.

The multiple opening configuration of impact driven tool 50 is preferable in large impact driven tools because it avoids a large opening and a single termination point thereof which might adversely affect the strength or durability of the impact driven tool. Also, the staggered depths of the openings may be utilized to take advantage of the interplay between the depth of a particular opening and the reduction in noise level achieved on varying work surfaces at varying frequencies to achieve good results on all surfaces and at all frequencies. Again, substantial reductions in the noise level produced by operating the impact driven tool 50 are achieved over prior art impact driven tools of similar size without sacrificing strength or performance.

Figure 4:
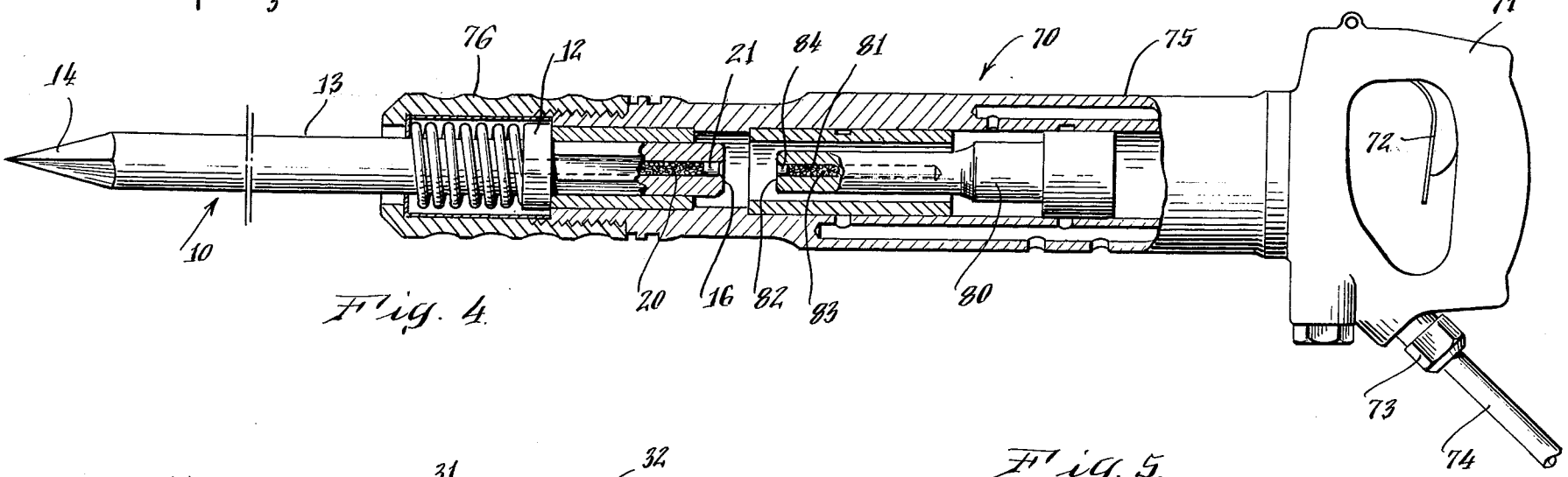
FIG. 4 is a side elevation view, partially in section, of a pneumatically powered impacting apparatus and an impact driven tool received therein, all according to the invention herein.

Referring now to FIG. 4, the impact driven tool 10 as shown is mounted in an impacting apparatus 70, which is more commonly known as an air hammer or a pneumatic drill. The air hammer 70 generally comprises a handle 71 including a trigger 72, a fitting 73 adapted to be connected to a source of compressed air by a hose 74, and valve means (internal and not shown) for controlling the compressed air to operate the air hammer. The air hammer 70 further comprises a body portion 75 having a ram 80 slideably mounted therein. The ram 80 is rapidly and repeatedly driven against the impact surface 16 of the impact driven tool 10 by the compressed air. The impact driven tool 10 is loosely restrained in the air hammer 70 by means of a cap 76 threadably mounted to the end of the body 75, and the shank 13 and tip 14 of the impact driven tool 10 protrude from the end of the air hammer 70 for engaging a work surface. The air hammer 70 shown in FIG. 4 is a commercially available Ingersoll-Rand Tool, except for the modifications to the ram 80 which will be described below.

The ram 80 is provided with at least one opening 81 extending upwardly from its impact face 82. The opening 81 preferably extends axially along approximately one-half or more of the length of the ram 80. Sound attenuating material, such as steel shot 83, is loosely packed in the opening 81, and the opening 81 is sealed with a plug 84 secured by a weld, similar to the manner described above with respect to the various impact driven tools. It should be noted that the multiple opening approach described above with respect to impact driven tool 50 may be readily applied to the larger rams of larger air hammers.

The use of the air hammer 70 described above including the internally silenced ram 81, with a standard tool, results in substantially reduced noise levels, and the use of both an impact driven tool according to the invention herein and the air hammer with the internally silenced ram according to the invention herein achieves noise reductions of more than 3 decibels without affecting the strength, durability or performance thereof.

Thus, the objects of the invention are well achieved in that reductions of noise levels are attained during operation of impact driven tools according to the invention herein and during operation of impacting apparatus including an internally silenced ram according to the invention herein, either individually or in combination. The strength, durability and performance thereof are not affected. The invention is particularly advantageous in that the silencing means is entirely internal to the impact driven tools and the rams of the air hammers, whereby the invention can be practiced without modifying existing equipment except, of course, for providing the openings and sound attenuating materials in the appropriate parts thereof as described above.

While the invention has been described above as it applies to impact driven tools and the rams of air hammers, it is also applicable to all kinds of structures where it is desired to reduce the noise level produced by impacted and impacting objects. Accordingly, it will be appreciated that various changes and modifications can be made in the preferred embodiments described above without department from the spirit and scope of the invention, which is limited only by the following claims.

What I claim is:

1. An internally silenced impact driven tool comprising a bitter end having an impact surface on one end thereof, a collar bounding the bitter end at the other end thereof, a shank, and a tip, said bitter end defining at least a portion of at least one opening in said impact driven tool, and sound attenuating material positioned and secured within said opening, said sound attenuating material comprising round hard metal shot.

2. An internally silenced impact driven tool as defined in claim 1 wherein said round hard metal shot is loosely packed in and substantially fills said opening.

3. An internally silenced impact driven tool as defined in claim 1 wherein said at least one opening comprises a single opening axially disposed within said impact driven tool.

4. An internally silenced impact driven tool as defined in claim 3 wherein said opening extends through said bitter end and terminates within said collar.

5. An internally silenced impact driven tool as defined in claim 3 wherein said opening extends through said bitter end and said collar and terminates within said shank.

6. An internally silenced impact driven tool as defined in claim 1 wherein a plurality of openings are at least partially defined by said bitter end.

7. An internally silenced impact driven tool as defined in claim 6 wherein each of said plurality of openings is parallel to the axis of said impact driven tool and wherein each of said plurality of openings has a depth differing from the depths of the others of said plurality of openings.

8. An internally silenced impact driven tool as defined in claim 1 wherein said round hard metal shot is steel shot having a diameter of approximately 0.030 inch.

9. An internally silenced impact driven tool as defined in claim 8 wherein said opening is sealed by a force fit plug secured by a weld.

10. An internally silenced impact driven tool comprising:

a. a bitter end having an impact surface at one end thereof;

b. a collar bounding the bitter end opposite the impact surface thereof;

c. a shank extending from said collar opposite said bitter end;

d. a tip located at the end of said shank, said bitter end, collar, shank, and tip axially aligned along a common axis of said impact driven tool;

e. said bitter end defining at least a portion of an opening extending from the impact surface along the axis of the impact driven tool to or below said collar thereof;

f. sound attenuating material comprising round hard metal shot loosely packed and substantially filling said opening;

g. a plug force fit into said opening to retain said round hard metal shot therein, said plug secured within said opening by a weld ground smooth with the impact surface.

11. An internally silenced ram for an impacting apparatus such as an air hammer used in combination with impact driven tools, said ram defining at least one internal opening therein, and sound attenuating material positioned and secured within said opening, said sound attenuating material comprising round hard metal shot.

12. An internally silenced ram as defined in claim 11 wherein said opening is parallel to the axis of said ram.

13. An internally silenced ram as defined in claim 11 wherein said at least one internal opening comprises a plurality of openings each parallel to the axis of said ram.

14. An internally silenced ram as defined in claim 11 wherein said round hard metal shot is loosely packed in and substantially fills said opening.

15. An internally silenced impact driven tool comprising a bitter end having an impact surface on one end thereof, a collar bounding the bitter end at the other end thereof, a shank, and a tip, said bitter end defining at least a plurality of openings in said impact driven tool, and sound attenuating material positioned and secured within said openings.

16. An internally silenced impact driven tool as defined in claim 15 wherein each of said plurality of openings is parallel to the axis of said impact driven tool and wherein each of said plurality of openings has a depth differing from the depths of the others of said plurality of openings.

* * * * *